US006340262B1

(12) United States Patent
Komiya et al.

(10) Patent No.: US 6,340,262 B1
(45) Date of Patent: Jan. 22, 2002

(54) WRITING IMPLEMENT WITH AN INK COLLECTOR

(75) Inventors: Motohiro Komiya, Tokyo; Hisashi Iida, Yokohama, both of (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/646,940

(22) PCT Filed: Mar. 26, 1999

(86) PCT No.: PCT/JP99/01568

§ 371 Date: Sep. 21, 2000

§ 102(e) Date: Sep. 21, 2000

(87) PCT Pub. No.: WO99/50079

PCT Pub. Date: Oct. 7, 1999

(30) Foreign Application Priority Data

Mar. 26, 1998 (JP) ..... 10-096926

(51) Int. Cl.[7] ..... B43K 5/02

(52) U.S. Cl. ..... 401/224; 401/199; 401/198

(58) Field of Search ..... 401/224, 198, 401/199, 205, 209, 217, 219, 222, 223, 225, 227

(56) References Cited

U.S. PATENT DOCUMENTS 3,572,954 A * 3/1971 Cheron ..... 401/18
3,901,608 A * 8/1975 Phillips ..... 401/135
5,217,313 A * 6/1993 Tamura et al. ..... 401/48
5,556,215 A * 9/1996 Hori ..... 401/199
5,906,446 A * 5/1999 McCulloch et al. ..... 401/199

FOREIGN PATENT DOCUMENTS

| | | | | |
|---|---|---|---|---|
| DE | 1511344 | * | 7/1969 | ..... 401/198 |
| EP | 0256615 A | * | 4/1987 | ..... 401/198 |
| JP | 62-28465 | | 7/1987 | |
| JP | 63-60376 | | 4/1988 | |
| JP | 64-55086 | | 5/1989 | |
| JP | 2517432 | | 11/1996 | |
| JP | 2555094 | | 11/1997 | |

* cited by examiner

*Primary Examiner*—David J. Walczak
*Assistant Examiner*—Huyen Le
(74) *Attorney, Agent, or Firm*—Darby & Darby

(57) ABSTRACT

A writing implement with an ink collector is able to prevent ink soiling at the pen tip even when the writing implement has been left under an atmosphere of 0° C. or below, at which the ink inside the writing implement will begin freezing and can be assembled by a simple assembling machine with its productivity improved.

This writing implement with an ink collector is a direct ink storage type writing implement having an ink chamber 2 disposed at the rear part of a barrel cylinder 1 for directly storing the ink and an ink collector 5 mounted at the front part of barrel cylinder 2 and is characterized in that ink collector 5 is formed with a passage hole 6 therein in which an ink conduit core 8 for conveying the ink from ink chamber 2 to a pen tip 10 is provided while the flank of ink collector 5 is formed with air holes 7 that communicate with passage hole 6.

1 Claim, 4 Drawing Sheets

WRITING IMPLEMENT WITH AN INK COLLECTOR

DESCRIPTION

1. Technical Field

The present invention relates to a direct ink storage type writing implement with an ink collector, having an ink chamber disposed at the rear part of the barrel cylinder for directly storing the ink and an ink collector mounted at the front part of the barrel cylinder.

2. Background Art

In general, a typical direct ink storage type writing implement has an ink chamber for directly storing the ink, instead of occluding the ink with a sliver or the like and also has an ink collector which temporarily retains the ink in order to prevent the ink, which is pushed out from the ink chamber when the air in the ink chamber expands due to a temperature rise, from blotting from the pen point or air holes. The writing implements are usually applied to marking pens, ball-point pens and the like.

The ink used in such a direct ink storage type writing implement is typically a water-based ink, including a coloring material made up of pigments and/or dyes, a solvent such as ethylene glycol, glycerin, propylene glycol and the like, water and other additives for writing implements.

The ink collector in a conventional writing implement has a passage hole therein in which an ink conduit core for conveying the ink from the ink chamber to the pen point is provided. This ink conduit core is press fitted or loosely fitted with some gap at the rear part of the passage hole of the ink collector. When this writing implement is oriented downwards or is laid laterally immediately after its assembly, the rear part of the ink collector and the rear end of the ink conduit core are wetted with ink so that the ink collector will be sealed at its rear end with ink.

Because of this sealing, the passage hole communicates with the atmosphere only by way of the pen tip. Therefore, as the ink from the ink chamber permeates through the capillaries of the ink conduit core and reaches the pen tip, the ink pushes the air inside the capillaries of the ink conduit core forwards so that the air thus pushed is discharged from the tip of the pen point while the space, or the capillaries, of the ink conduit core is filled up with ink, finally allowing writing.

However, once this state is established, particularly for the case of an writing implement having as its writing tip a ball point, the space between the pen point holder and the tip is filled up with ink so that the gap between the passage hole of the ink collector and the ink conduit core becomes confined.

In this situation, if this writing implement is left under an atmosphere of 0° C. or below, the water-based ink will freeze inside the writing implement, expanding its volume, consequently the unfrozen solvent is pushed out from the pen tip by the volume expansion, soiling the pen tip.

Further, in the conventional ink collector, the air inside the ink conduit core needs to be pushed out from the tip of the pen point from when the writing implement is assembled until the ink, passing through the ink conduit core, reaches the pen tip. In particular, for the case of a writing implement having as its writing tip a ball point, the clearance between the ball and the ball holder is so small that it is hard to release the air which is pushed from the rear by the ink. As a result, it takes a long time for the ink to reach the tip of the pen point. Because it takes a long time before the writing test of the writing implement after the assembly of the writing implement, it is impossible to increase the total production rate even if the assembly rate of the writing implement is increased.

Moreover, in order to enhance the assembly rate, there is an idea that the writing implement after assembly is held still, temporarily until the ink reaches the pen tip. However, this method has the drawback of the assembling machine being complicated.

In view of the above conventional drawbacks and to solve them, it is an object of the present invention to provide a direct ink storage type writing implement with an ink collector, which is able to prevent the solvent etc., contained in the ink from being pushed out from its pen tip when the writing implement has been left under the atmosphere of 0° C. or below and hence prevent soiling at its pen point and of which the assembling machine can be simplified with its productivity improved.

DISCLOSURE OF INVENTION

The inventors hereof have earnestly studied about the above conventional drawbacks, and have found a particular flank configuration of the ink collector having a passage hole in which the ink conduit core for supplying ink from the ink chamber to the pen tip is arranged, and finally have completed a writing implement with an ink collector which satisfies the above object.

That is, a writing implement with an ink collector of the present invention is a direct ink storage type writing implement comprising:

an ink chamber disposed at the rear part of the barrel cylinder for directly storing the ink; and an ink collector mounted at the front part of the barrel cylinder, and is characterized in that the ink collector is formed with a passage hole therein in which an ink conduit core for conveying the ink from the ink chamber to the pen point is provided while the flank of the ink collector is formed with air holes that communicate with the passage hole.

BEST MODE FOR CARRYING OUT THE INVENTION

The present invention will hereinafter be described in detail with reference to the accompanying drawings.

FIGS. 1 through 4 show an example of the embodiment of the present invention.

Figure 1:
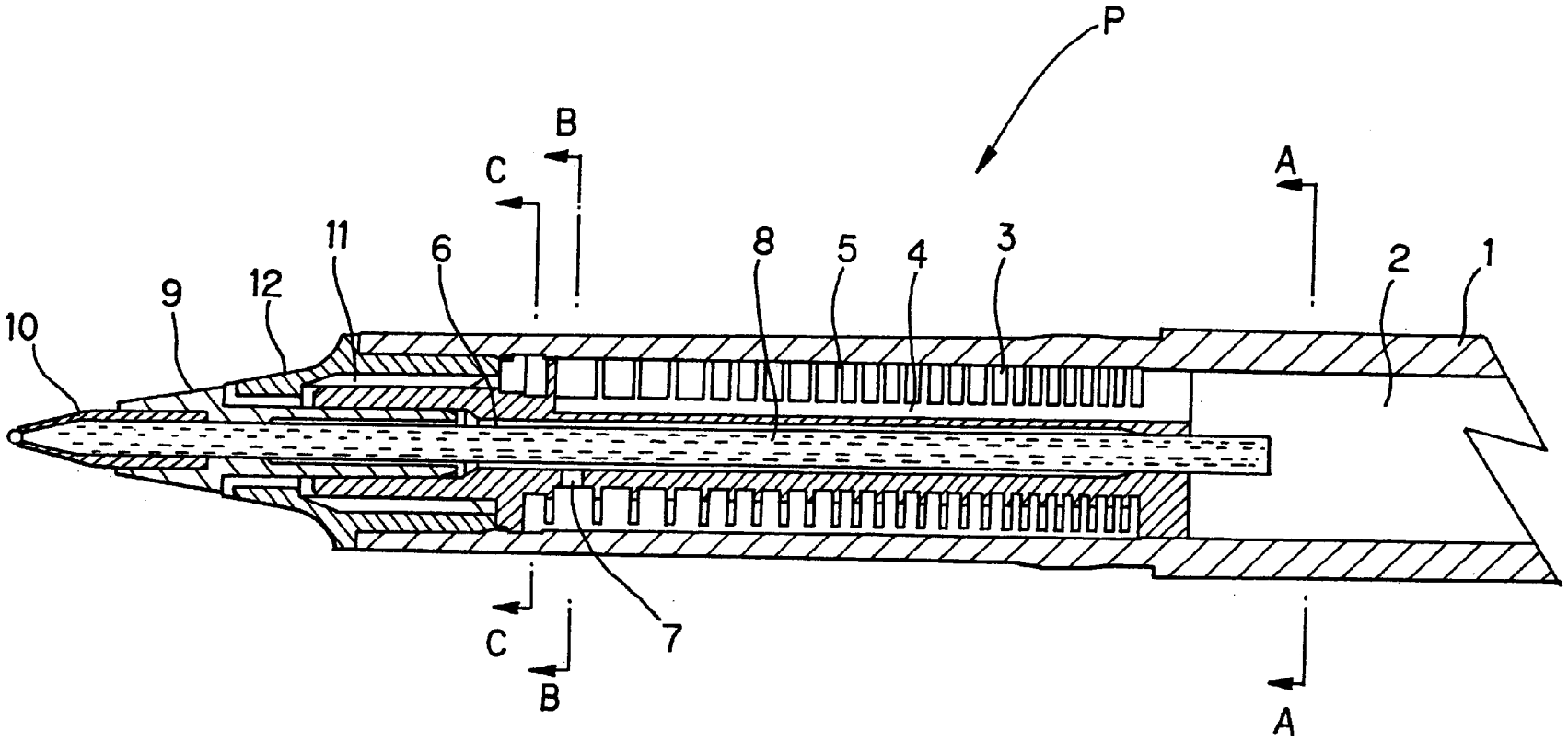
FIG. 1 is a vertical sectional view of a writing implement showing an example of the embodiment of the invention.

A writing implement P used in this embodiment is a ball-point pen. As shown in FIG. 1, a barrel cylinder 1 has an ink chamber 2 as its rear part and an ink collector 5 mounted in the front part thereof. Attached to the front end of this ink collector 5 is a pen tip holder 9 which holds a pen tip 10.

Figure 2:
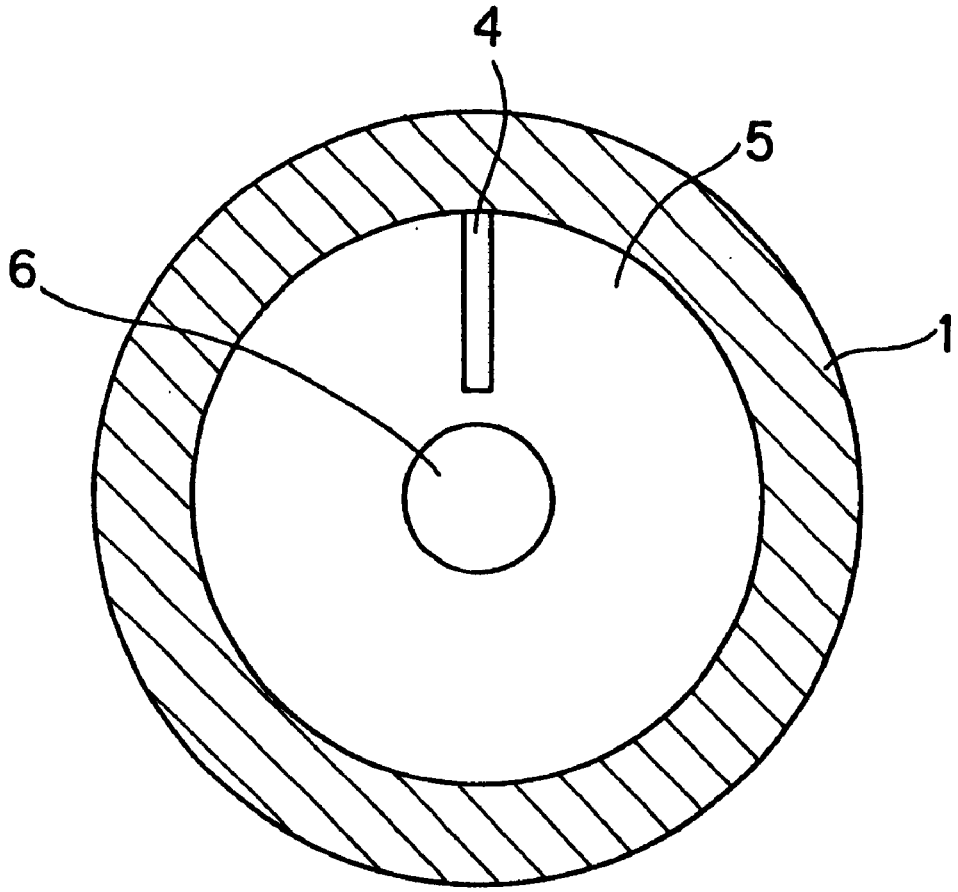
FIG. 2 is a vertical sectional view taken on a plane A—A in FIG. 1.

As shown in FIGS. 1 and 2, ink collector 5 has as retaining grooves 3 many annular grooves on the peripheral side thereof. A longitudinal groove 4 is formed to make these retaining grooves 3 communicate with each other. This longitudinal groove 4 is connected to ink chamber 2 and has the functions of permitting the ink to pass therethrough to retaining grooves 3 and be temporarily retained therein when the ink is pushed out from ink chamber 2 by the air expansion due to change in temperature in ink chamber 2 and permitting the ink in retaining grooves 3 to return to ink chamber 2 when the air inside ink chamber 2 contracts and reverts itself to the original state, whereby the ink is prevented from blotting from pen tip 10.

A passage hole 6 extending axially is formed in the core of ink collector 5. An ink conduit core 8 is press fitted, or loosely fitted with some gap, through the passage hole 6 at the rear part (on the ink chamber side) of the passage hole 6 of the ink collector. The front end of ink conduit core 8 is connected to pen tip 10 so that the ink is supplied from the ink chamber 2 to pen tip 10.

Figure 3:
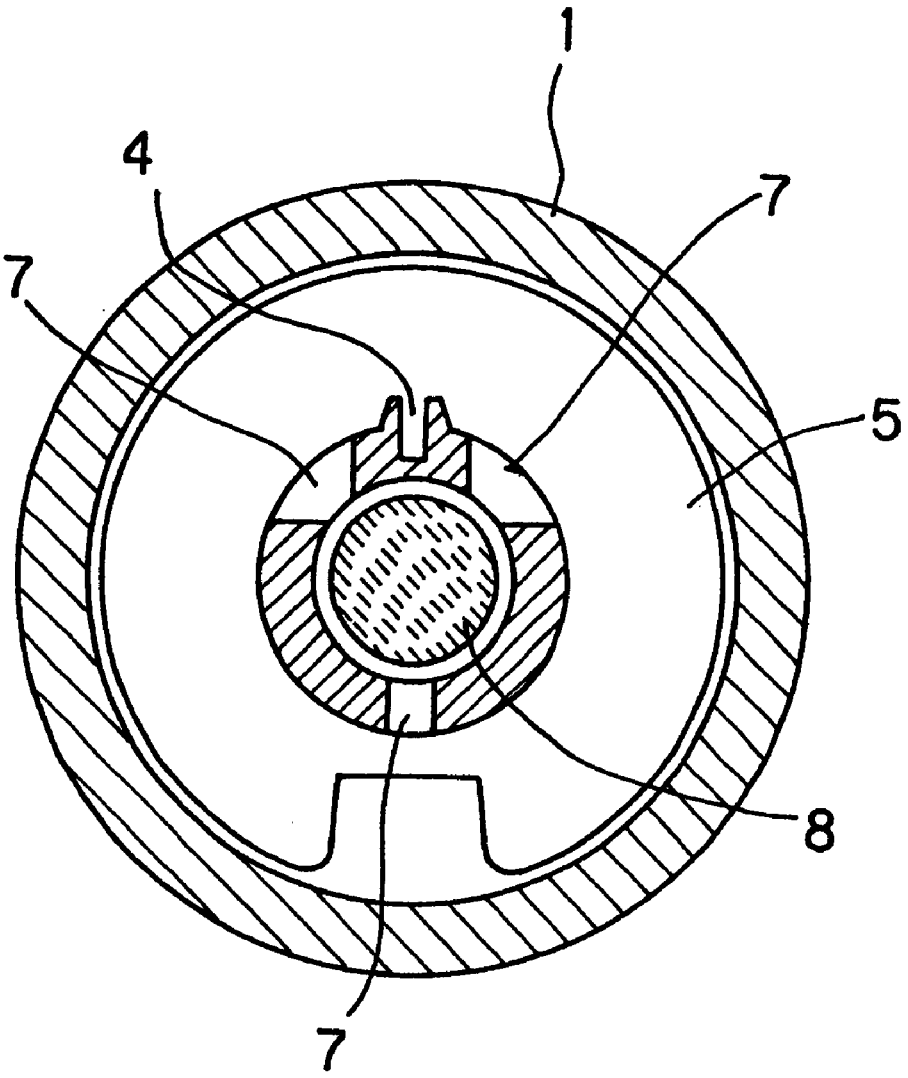
FIG. 3 is a sectional view taken on a plane B—B in FIG. 1.
Figure 4:
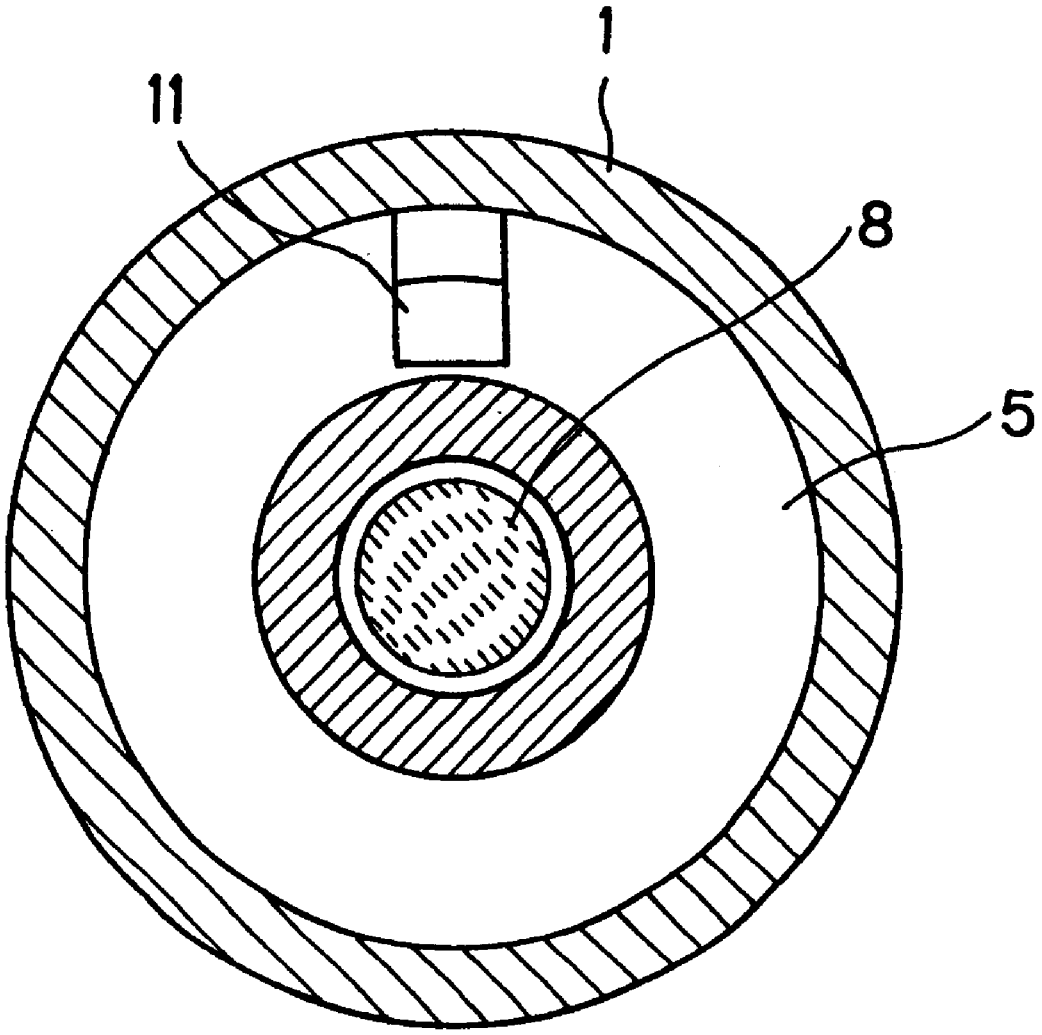
FIG. 4 is a sectional view taken on a plane C—C in FIG. 1.

As shown in FIGS. 1 and 3, formed on the flank of ink collector 5 having passage hole 6 through which ink conduit core 8 is fitted to supply the pen tip 10 with the ink from ink chamber 2 are air holes 7. In this embodiment, air holes 7 that communicate with passage hole 6 are provided in the flank of foremost one of many retaining grooves 3 of ink collector 5, and three air holes 7 are formed as shown in FIG. 3.

Ink conduit core 8 fitted through passage hole 6 of ink collector 5 is formed of a bar which is made up of a great deal of fine fibers bundled and bonded with resin etc., thus creating longitudinal capillaries to convey the ink from ink chamber 2 to pen tip 10. These capillaries are formed so as to communicate with each other and communicate with the outside via the peripheral surface.

In this embodiment, ink in ink chamber 2 is a water-based ink, including a coloring material made up of pigments and/or dyes, a solvent of ethylene glycol, glycerin, propylene glycol and the like, water and other additives for writing implements (dispersant, preservative etc.).

Designated at 12 in the figure is a front barrel part for fixing pen tip holder 9 to barrel cylinder 1.

In writing implement P of this embodiment thus configured, when the pen has been initially assembled, ink in the ink chamber 2 moves from the rear part of ink conduit core 8 through the capillaries of ink conduit core 8 and reaches pen tip 10 as pushing the air out. At this point, when ink from ink chamber 2 wets the rear part of ink collector 5, the ink serves as a sealer even if there is some gap between passage hole 6 and ink conduit core 8 so that air cannot communicate therethrough.

Therefore, once the ink moves forwards from the rear end of ink conduit core 8, the air inside ink conduit core 8 will be pushed out by the ink. The air thus pushed out advances along the peripheral surface of ink conduit core 8 and is discharged to the outside of ink collector 5 through air holes 7 formed on the flank of ink collector 5 at least until the ink reaches the point where the gap between pen tip holder 9 and ink conduit core 8 becomes terminated. The discharged air is further discharged by way of a vent 11 to the outside. After this point, the air pushed out from ink conduit core 8 by the ink is discharged through a narrow channel in pen tip 10.

Thus, since this writing implement P with an ink collector 5 has air holes 7 which are formed in the flank of ink collector 5 so as to communicate with passage hole 6, the air pushed by the ink entering ink conduit core 8 after assembly is discharged through air holes 7 so that the time taken for the ink to move from ink chamber 2, pass through ink conduit core 8 to pen tip 10, can be reduced. Therefore, the time required after assembly of the writing implement to its writing test is shortened without the necessity of holding the writing implement still for a long time until the ink reaches the pen tip while the assembling machine can be simplified with Its productivity improved.

Even when this writing implement P with an ink collector 5 has been left Indoors or outdoors under an atmosphere of air corresponding to the volume expansion can be discharged to the outside of ink collector 5 via air holes 7 formed on the flank of ink collector 5 so as to prevent the ink from being pushed out from the pen tip, hence no soiling will occur at the pen tip.

The writing implement with an ink collector of the present invention is thus configured, but the invention should not be limited to the above embodiment and various changes and modifications can be made without departing from the scope and sprit of the present invention.

In conclusion, the main feature of the writing implement with an ink collector of the present invention is that the ink collector is formed with a passage hole therein in which an ink conduit core for conveying the ink from the ink chamber to the pen point is provided while the flank of the ink collector is formed with air holes that communicate with the passage hole. This configuration provides the effects as follows:

1) simplification of the assembling machine and improvement of the productivity, by shortening the time for the initial filling of ink after assembly, or the time taken for the ink to move from the ink chamber, pass through the ink conduit core to the pen tip; and 2) prevention against the soiling at the pen tip even when the writing implement has been left under an atmosphere in which the ink inside the writing implement will become frozen, i.e., under an atmosphere of 0° C. or below, and expanded its volume. Therefore, the configurations irrelevant to the feature of the present invention, for example, the shapes and configurations of the barrel cylinder, ink conduit core, etc., are not particularly limited. Further, as long as the above first and second effects can be attained, the positions, shape and number of the air holes provided in the flank of the ink collector should not be particularly limited.

INDUSTRIAL APPLICABILITY

As has been described heretofore, according to the writing implement with an ink collector of the present invention, it is possible to prevent ink soiling at the pen tip even when the writing implement has been left under an atmosphere of 0° C. or below, at which the ink inside the writing implement will begin freezing while the assembling machine can be simplified with the productivity improved.

What is claimed is:

1. A direct ink storage type writing implement with an ink collector, comprising:

an ink chamber disposed at a rear part of a barrel cylinder for directly storing the ink; and an ink collector mounted at a front part of the barrel cylinder, characterized in that the ink collector is formed with a passage hole therein in which an ink conduit core for conveying the ink from the ink chamber to a pen point is provided while a flange on the ink collector is formed with air holes that communicate with the passage hole and the passage hole is greater in diameter than the ink conduit core, creating a space between the passage hole and the ink conduit core, and the air holes are formed in the space and in a foremost part of the collector where a wide retaining groove is arranged.

* * * * *